United States Patent [19]

Lorentzon

[11] Patent Number: 5,030,124

[45] Date of Patent: Jul. 9, 1991

[54] BULB SOCKET

[75] Inventor: Rune Lorentzon, Skövde, Sweden

[73] Assignee: El-Akta System AB, Skovde, Sweden

[21] Appl. No.: 602,245

[22] PCT Filed: May 24, 1989

[86] PCT No.: PCT/SE89/00293

§ 371 Date: Nov. 16, 1990

§ 102(e) Date: Nov. 16, 1990

[87] PCT Pub. No.: WO89/11741

PCT Pub. Date: Nov. 30, 1989

[30] Foreign Application Priority Data

May 24, 1988 [SE] Sweden ..... 8801926

[51] Int. Cl.[5] ..... H01R 29/00

[52] U.S. Cl. ..... 439/188; 200/51.09

[58] Field of Search ..... 439/135, 188, 611, 613, 439/615, 924; 200/51 R, 51.09, 51.1

[56] References Cited

U.S. PATENT DOCUMENTS

| | | | |
|---|---|---|---|
| 2,439,385 | 4/1948 | Goldberg | 200/51.09 |
| 3,895,195 | 7/1975 | Morrison et al. | 200/51.09 |
| 3,915,536 | 10/1975 | Glantz | 439/188 |
| 4,513,182 | 4/1985 | Juntti | 200/51.09 |

*Primary Examiner*—Neil Abrams
*Assistant Examiner*—Khiem Nguyen
*Attorney, Agent, or Firm*—Sughrue, Mion, Zinn, Macpeak and Seas

[57] ABSTRACT

When screwing in a bulb into the lamp-holder according to the invention, which is carried out in an axially somewhat movable, threaded yoke (4), initially, via one of two resilient contacts (20, 21) associated with contacts (19) provided on an outer plate (15) which is somewhat movable wth respect to the yoke, the outer plate and an inner plate (9) provided with a pair of contacts (12) and immovable with respect to the yoke, are pressed towards each other until a stop (*7a, 7b*) on the lamp-holder housing (1) arrests the outer plate or the yoke before the pairs of contacts are brought together. By the continued threading motion of the bulb and by the fact that now the outer plate or the yoke are immovable with respect to the housing the plates are moved towards each other until their contact pairs are brought together and the yoke or the outer plate is arrested by the said stop. The contact pairs cannot be brought together by an object without it cooperating with the thread (5) of the yoke.

4 Claims, 2 Drawing Sheets

BULB SOCKET

It is of extreme importance that such electric mass products as holders for electric glow lamps are of such design that the hazard the user is exposed to when using them is as small as possible. This hazard should preferably be completely non-existent since a very great number of users of holders for electric lamps are not aware of or appreciate only vaguely the potential risks associated with holders for high-tension current lamps.

There is, in fact, no lamp-holder on the market that is completely free from risks for the user. Thus, as far as is known, in all types of lamp-holders it is possible to introduce an elongated object of conductive material into a lamp-holder having no lamp screwed into it, press a contact or contact holder and thus close a circuit which includes the elongated object.

The invention thus has for its purpose the provision of a holder for high-tension current lamps of a structure precluding the above hazardous procedure so that the lamp-holder according to the invention can be characterized as a safe a high-tension lamp-holder as can possibly be made.

This purpose is attained by a lamp-holder according to the claims.

Figure 1:
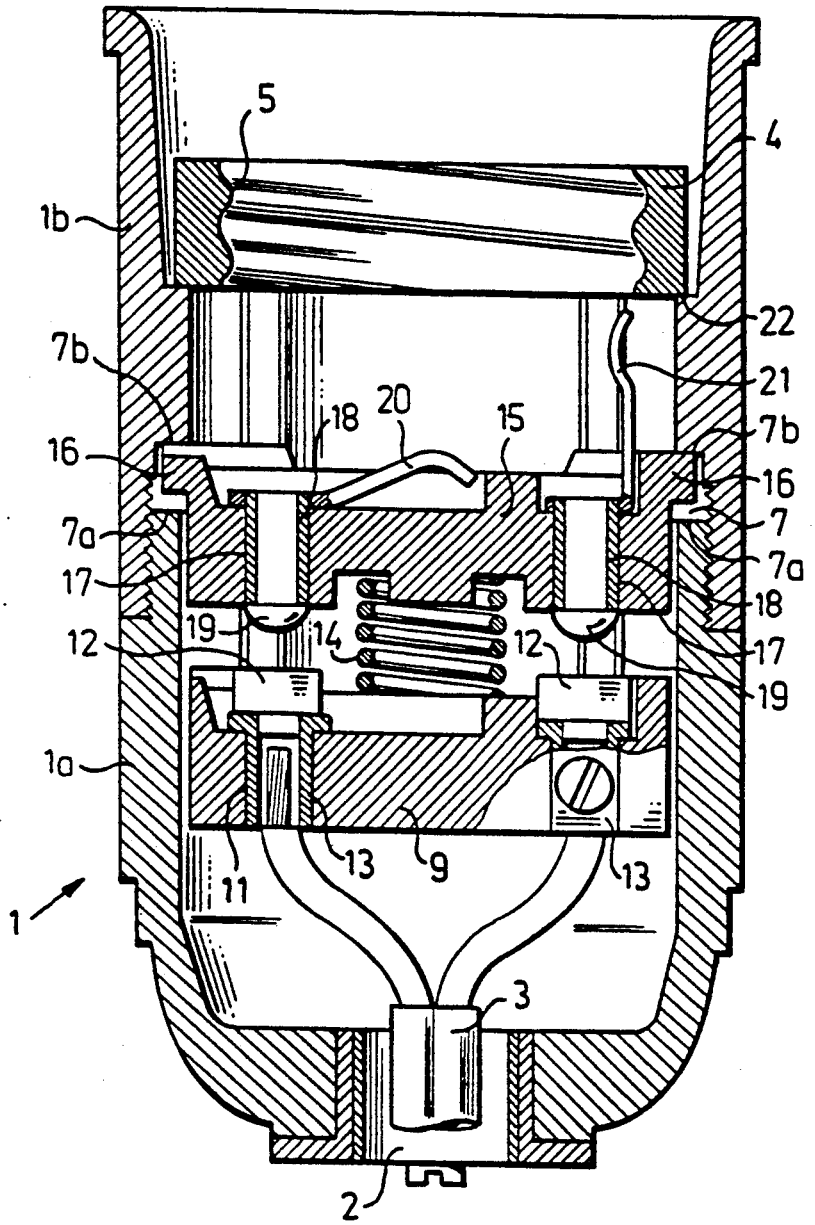
Figure 2:
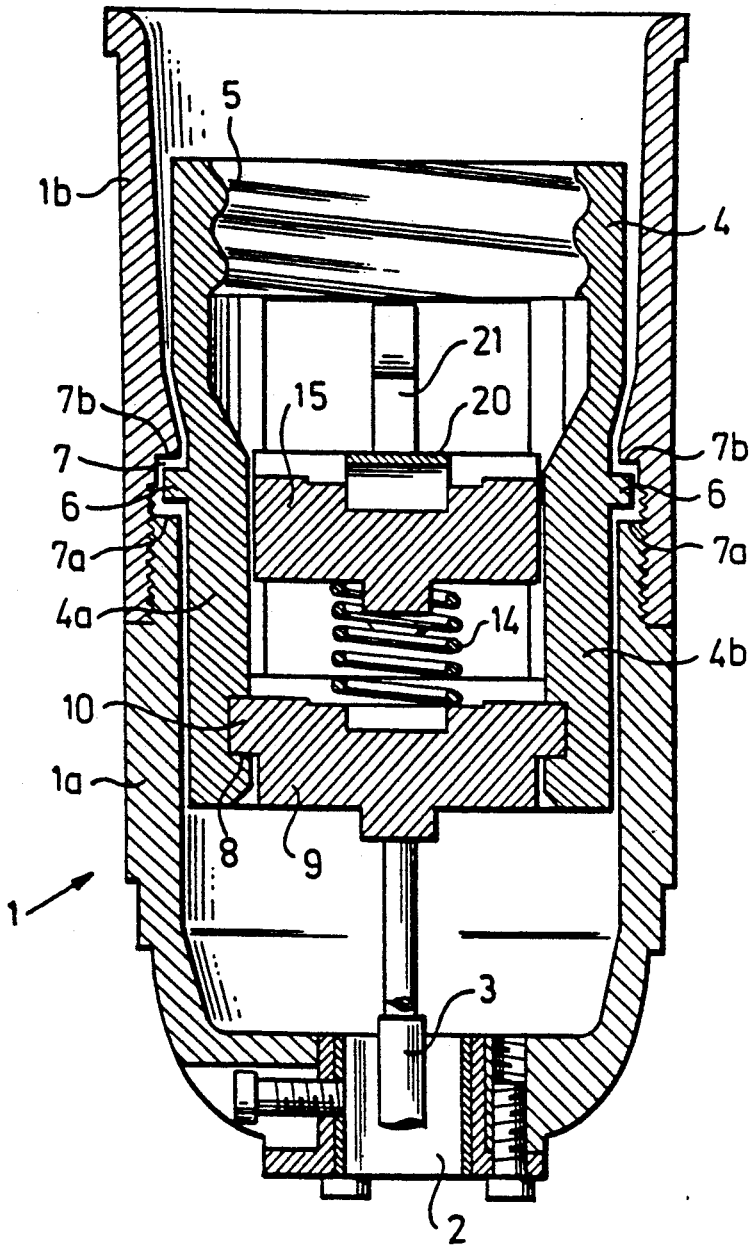

The invention will be explained in detail below and with reference to the attached drawings, wherein FIG. 1 represents a central vertical section through an embodiment of the lamp-holder according to the invention, and FIG. 2 a central vertical section through the lamp-holder of FIG. 1 with the plane of section being at right angles to the plane of section of FIG. 1.

The embodiment of the lamp-holder according to the invention shown in the Figures of the drawings comprises a conventional, substantially cylindrical housing 1 consisting, with respect to a lamp screwed into it, of an inner portion 1*a* having a central aperture 2 at the inner end thereof and a conventional arrangement associated therewith for receiving and fixing a two-wire electric conductor 3, and an outer portion 1*b* threaded to the inner portion 1*a* and open at its outer end to permit insertion of a bulb into the holder with its threaded base. The housing is manufactured from a non-conductive material.

In housing 1 there is provided a yoke 4 which is inserted into housing 1 before the two portions 1*a*, 1*b* thereof are screwed together. Yoke 4 is also made from a non-conductive material and has at its outer end a female thread 5 for the thread of a base. From the portion of yoke 4 which is provided with thread 5 a pair of diametrically opposed yoke legs 4*a*, 4*b* extend inwardly. Each one of these has, on the radially outer side thereof and about midway between the outer and inner end of yoke 4, a circular projection 6 of a preferably rectangular cross section and accomodated with ample clearance radially as well as axially in a circular groove or recess 7 in the interior wall of housing 1 and formed by a notch at the inner end of housing portion 1*b* and the outer edge of housing portion 1*a*. The axial clearance of projections 6 preferably is in all of the order of two or three millimeters.

Each leg 4*a*, 4*b* of yoke 4 is provided with an interior face groove 8, adjacent the inner ends thereof and preferably of rectangular cross section, grooves 8 being mutually opposed in the legs and adapted to receive projections 10 provided at mutually opposed edges of a plate 9 and having a shape in cross section corresponding to that of grooves 8 and dimensioned to be insertable with a close fit into grooves 8. Plate 9 is manufactured from a non-conductive material.

Plate 9 is provided with a couple of through holes 11 located on either side of the centre thereof and lined in a conventional manner by sleeves 13 of a conductive material provided at the tops thereof with contacts 12 of a conductive material. The ends of the separated and from insulating material stripped end portions of electric conductor 3, are inserted into sleeves 13 and fixed in a conventional manner. These ends carry plates 9 and hence yoke 4.

Plate 9 carries on the outer face thereof a relatively short compression spring 14 which is concentric with the vertical central axis of the lamp-holder. In its turn spring 14 carries and biases upwardly an outer plate 15 consisting of a non-conductive material and having a pair of mutually opposed circular projections 16 provided at the axially and radially outer edges of outer plate 15. They preferably have a rectangular cross section and are dimensioned to fit, with an ample clearance axially as well as radially, within sections of groove 7 of housing 1 not occupied by projections 6 of yoke legs 4*a* and 4*b*. The axial clearance of projections 16 in groove 7 is of the order of two or three millimeters in all.

Outer plate 15 is provided with a pair of through holes 17 which, in the assembled position of the two plates 9 and 15, are located opposite holes 11 and contacts 12 of inner plate 9. As is conventional, each hole 17 is lined with a sleeve 18 of a conductive material and having each a contact 19 protruding slightly from the inner face of plate 15, one of the contacts being connected with a resilient contact element 20 and the other contact with a resilient contact element 21, each contact element, also in a conventional manner, being adapted to engage a conductive surface of the bulb upon this being threaded into thread 5 of yoke 4.

Since yoke 4 is carried by only the two wires of conductor 3 the interior face of housing 1 adjacent the outer end thereof preferably is provided with a peripheral, inwardly directed shoulder 22 of shorter radius than the threaded portion of yoke 4 and hence limiting the inward motion of the yoke.

From the above description it is evident that yoke 4 is axially movable outwardly and inwardly by an amount of about a millimeter with respect to housing 1, that outer plate 15 is axially movable with respect to yoke 4 by substantially the same amount, and that inner plate 9 is immovable with respect to yoke 4.

If an elongated object is inserted into the lamp-holder and is pressed against resilient contact 20 and hence against outer plate 15 the latter, against the action of spring 14, will be pushed inwardly towards inner plate 9 by an amount of about a millimeter. The inward motion is arrested by projection 16 of plate 15 with its axially inner edges engaging axially inner edge 7*a* of groove 7. Now, the dimensions are such that the inward motion of plate 15 towards plate 9 is arrested before contacts 19 can engage contacts 12. Irrespective of the load the elongated object is made to exert (within reasonable limits) against plate 15 the latter cannot be pressed inwardly to such an extent that contacts 19 may engage contacts 12 which means that there is no risk of an electric circuit including the elongated object being closed.

However, if now instead a bulb is screwed into thread 5 with its threaded base the inner contact surface of the bulb will first engage resilient contact 20 at the same time that in the usual manner the thread of the bulb base engages resilient contact 21. When the screwing in of the bulb base is continued plate 15 is pressed inwardly against the action of spring 14 until projection 16 of plate 15 engages axially inner edge *7a* of groove 7. With continued screwing in of the bulb base, since projections 16 bear against inner edge *7a* of groove 7, yoke 4 will be threaded outwardly until, after an outward movement of the order of a millimeter, its projections 6 with the axially outer surfaces thereof engage axially outer edge *7b* of groove 7. At the same time contacts 19 now have engaged contacts 12 and an electric circuit between the two conductors has been closed via contacts 12, 13 and the contact surface on the bulb base and the filament of the bulb.

The movements of the yoke and plate 15 described above may also take place in the reversed order.

The closing of an electric circuit evidently requires a conductive object which can bring about a cooperation between thread 5 and plate 15, which is movable with respect to the thread, and a stop for plate 15 which is independent of yoke 4 carrying thread 5. Such a cooperation can only be brought about by a bulb which fits thread 5 and not by other objects which can be inserted into the holder to exert a load against plate 15. Hence, the lamp-holder according to the invention offers as great a safety as conceivably can be attained for such a device. One advantage is that this can be achieved by a cheap solution well suited to mass production and without it having been necessary to alter the outside appearance or dimensions of the lamp-holder with respect to conventional lamp-holders except that the lamp-holder according to the invention is a few millimeters longer than at present commercially available lamp-holders.

I claim:

1. A lamp-holder having a substantially cylindrical outer housing (1) provided at one end with an aperture (2) and preferably with means for fixing a two-wire electric conductor (3) introduced into the aperture and being open at the opposite end to permit introduction of a bulb, and a yoke (4) provided within the housing (1) and movable to a limited extent and having, somewhat inside the open end of the housing, a female thread (5) corresponding to the male thread of the bulb base, characterized in that, at some distance from and inside the inner end of the female thread, the yoke (4) is provided with an outer plate (15) which is axially movable with respect to the yoke and has a pair of contacts (19) protruding slightly from the inner face thereof, said contacts being each conductively connected with a resilient contact element (20, 21) projecting from the outer face of the plate and adapted, upon the bulb being screwed in, to engage corresponding conductive elements on the bulb, a pair of yoke legs (*4a*, *4b*) which extend inwardly from the portion of the yoke provided with the thread into the housing to some distance outside the inner end of the housing being interconnected adjacent the inner ends thereof by an inner plate (9) which is immovable with respect to the rest of the yoke and has a pair of conductive lead-through elements (13) for receiving and fixing the two conductive wires of the conductor the portions of which that are located within the housing carrying the inner plate and hence the yoke and each being provided with a contact (12) opposite the contacts of the outer plate, said inner plate carrying on the outer face thereof a compression spring (14) in its turn carrying the outer plate which, upon a bulb being screwed into the thread, via one of the resilient contact elements (20) and against the action of the spring is pressed inwardly in the direction towards the inner plate until the outer plate, in a position in which its contacts (19) have not yet engaged the contacts of the inner plate, is arrested by a stop (*7a*) on the housing against continued inward motion, and, upon continued screwing in of the bulb, on account of the fact that now the outer plate is immovable with respect to the housing, the yoke being caused to move outwardly with its with respect thereto immovable inner plate and its contacts until the contacts of the inner plate engage the contacts of the outer plate and the yoke engages a stop (*7b*) on the housing against continued outward motion, the said movements being executable in the reversed order.

2. The lamp-holder of claim 1, characterized in that said stops (*7a*, *7b*) on the housing (1) against inward movement of the outer plate (15) and outward movement of the yoke (4) are defined by the axially inner and outer edge, respectively, of a peripheral groove (7) in the inner wall of the housing.

3. The lamp-holder of claim 2, characterized in that the peripheral groove (7) in the inner wall of the housing (1) is defined, one one hand, by an inner face notch at the inner edge of an outer housing portion (*1b*), and, on the other hand, of an axially outer edge of an inner housing portion (*1b*), the said two housing portions being detachably connectable, preferably by being interthreadable.

4. The lamp-holder of any preceding claim, characterized by a shoulder (22) on the inner face of the housing (1) and cooperating with the threaded portion of the yoke (4) to limit the amount of inward movement of the yoke.

* * * * *